US009601290B2

(12) United States Patent
De Barros Albuquerque et al.

(10) Patent No.: US 9,601,290 B2
(45) Date of Patent: Mar. 21, 2017

(54) SWITCHING DEVICE WITH SEVERAL REGIONS OF CONNECTION

(71) Applicants: WEG DRIVES & CONTROLS—AUTOMAÇÃO LTDA, Jaraguá do Sul—SC (BR); André De Barros Albuquerque, Jaraguá do Sul—SC (BR); Ivo Detlev Günther, Jaraguá do Sul—SC (BR); Juliano Bernardi Rosso, Jaraguá do Sul—SC (BR); Leonardo Luiz Vetore, Jaraguá do Sul—SC (BR)

(72) Inventors: André De Barros Albuquerque, Jaragua do Sul—SC (BR); Ivo Detlev Günther, Jaragua do Sul—SC (BR); Juliano Bernardi Rosso, Jaragua do Sul—SC (BR); Leonardo Luiz Vetore, Jaragua do Sul—SC (BR)

(73) Assignee: WEG DRIVES & CONTROLS—AUTOMAÇÃO LTDA, Jaragua do Sul—SC (BR)

( * ) Notice: Subject to any disclaimer, the term of this patent is extended or adjusted under 35 U.S.C. 154(b) by 92 days.

(21) Appl. No.: 14/428,420

(22) PCT Filed: Nov. 29, 2012

(86) PCT No.: PCT/BR2012/000488
§ 371 (c)(1),
(2) Date: Mar. 16, 2015

(87) PCT Pub. No.: WO2014/082144
PCT Pub. Date: Jun. 5, 2014

(65) Prior Publication Data
US 2015/0248983 A1 Sep. 3, 2015

(51) Int. Cl.
*H01H 9/02* (2006.01)
*H01H 13/04* (2006.01)
(Continued)

(52) U.S. Cl.
CPC ..... *H01H 50/14* (2013.01); *H01H 50/02* (2013.01); *H01H 50/08* (2013.01); *H01H 50/18* (2013.01);
(Continued)

(58) Field of Classification Search
CPC ..... H01H 50/14; H01H 50/443; H01H 50/60; H01H 50/02; H01H 50/08; H01H 50/18; H01H 50/541
See application file for complete search history.

(56) References Cited

U.S. PATENT DOCUMENTS 3,339,161 A 8/1967 Conner et al.
3,639,866 A 2/1972 Kane
(Continued)

FOREIGN PATENT DOCUMENTS

EP 2023364 10/2011
EP 1051718 7/2013

OTHER PUBLICATIONS

PCT International Search Report and Written Opinion for PCT/BR2012/000488, mailed on Mar. 25, 2013 (12 pages).

*Primary Examiner* — Bernard Rojas
(74) *Attorney, Agent, or Firm* — Finnegan, Henderson, Farabow, Garrett & Dunner LLP

(57) ABSTRACT

An electromagnetic switching device, with several distinct regions (10, 20, 30, 40), where each region separates and places the terminals and the connection means in an improved form which make easy the identification of the terminals for the user when the contactor is fixed inside the panel; where the first region (10), have function of fixing the
(Continued)

contactor on the panel and also houses the electromagnet; a second region (20) comprising the power terminals (21); a third region (30) that houses the auxiliary terminals (31, 32) and the command terminals (33); a fourth region (40)>> that is used for the connection of accessories; the third region presents a clear distinction between auxiliary terminals (31, 32) and command terminals (33), given by the asymmetry created viewed from the top; combined with a proposed uneven disposition X1 and X2 of the command terminals (31, 32) and auxiliary terminals (33) viewed from the front in the same third region.

23 Claims, 5 Drawing Sheets

(51) Int. Cl.

| | |
|---|---|
| ***H01H 50/14*** | (2006.01) |
| ***H01H 71/08*** | (2006.01) |
| ***H01H 50/02*** | (2006.01) |
| ***H01H 50/08*** | (2006.01) |
| ***H01H 50/18*** | (2006.01) |
| ***H01H 50/44*** | (2006.01) |
| ***H01H 50/54*** | (2006.01) |
| ***H01H 50/60*** | (2006.01) |

(52) U.S. Cl.
CPC ..... *H01H 50/443* (2013.01); *H01H 50/541* (2013.01); *H01H 50/60* (2013.01); *H01H 71/08* (2013.01)

(56) References Cited

U.S. PATENT DOCUMENTS

| | | | |
|---|---|---|---|
| 3,949,333 | A | 4/1976 | Freitag et al. |
| 4,006,440 | A | 2/1977 | Burton et al. |
| 6,232,859 | B1 | 5/2001 | Christensen et al. |
| 7,679,477 | B2 | 3/2010 | Portier |
| 8,159,321 | B2 | 4/2012 | Bollinger et al. |
| 2011/0205003 | A1 | 8/2011 | Koppmann |

SWITCHING DEVICE WITH SEVERAL REGIONS OF CONNECTION

CROSS REFERENCES TO RELATED APPLICATIONS

This application is a national stage filing under 35 U.S.C. §371 of International Application No. PCT/BR2012/000488, filed on Nov. 29, 2012. The disclosure of the above-referenced application is expressly incorporated herein by reference in its entirety.

FIELD OF THE INVENTION

The present invention patent describes a multipolar electromagnetic switching device, particularly a contactor that has an upper part which houses fixed contacts, this upper body is fixed to a base, inside these both parts there is an electromagnet composed by a coil and two armatures being one fixed and the other moveable, capable of moving a contact carrier that bears the movable contacts.

FUNDAMENTALS OF INVENTION

Generally, in an electromagnetic switching device, particularly a contactor, is usual that the power contacts are connected to power cables through power terminals, which are connected to fixed contacts that are switched by the moveable contacts where both are in the same area.

The command terminals are connected to the coil of the electromagnet and are situated in another region distinct of the mentioned above.

The auxiliary contacts are connected to the auxiliary cables through the auxiliary terminals, which are connected to fixed contacts that are switched by the moveable auxiliary contacts supported by the contact carrier, and these are in another distinct region.

The position of these regions can vary depending of the desired configuration and the features that are intended to provide to the final user. Depending on the chosen configuration, the electromagnet can be positioned in the upper part or in the lower part of the contactor, being the lower part, the one that is used for fixing the contactor to a support means and the upper part the one that the cables installation tools have access to the terminals.

In this universe of conceptions related to the configuration of power, auxiliary and command terminals, the configurations and constructive arrangements are numerous aiming the ease of accessories installation and different configurations, where particularly avoid connection mistakes is one of the most important elements in contactor configuration.

BACKGROUND OF INVENTION

In the state of art, there are several types of contactors, with numerous arrangements of the connections regions. The most part of contactors of the market houses the electromagnet in the lower part of the contactor, this way the command terminals are disposed in the same region due the practicability and cost reduction to perform the connection. Above that, the power region and more above the region of the auxiliary terminals that can be integrated or modular in their constructive form.

The contactor presented in the U.S. Pat. No. 4,006,440, shows a constructive disposal wherein the electromagnet is arranged in the lower part of the contactor and the command terminals are arranged in a region above the coil to ease the interconnection with other dispositive, particularly an overload relay. The U.S. Pat. No. 3,949,333, complements the mentioned patent, showing a side mounting auxiliary contact block that is connected to the contactor and activated by cams. The auxiliary terminals also are arranged in a region above the power contacts and the coil.

The patent EP1051718 granted in October 2005 and modified in October 2012, describes a contactor with the electromagnet in the lower part, wherein the disposal of the terminals is done using planes. Given that the power terminals plane is above the electromagnet and above that, exists also another plane that includes the command terminals and the auxiliary terminals, wherein, they are at the same plane and disposed side by side, sequentially starting from one side of the contactor. This disposition of the terminals grouped in one extremity of the contactor makes difficult to distinguish the command terminals from the auxiliary terminals.

In another way, there is the patent EP2023364, where is described a contactor with the electromagnet in the lower part. Above the electromagnet is the power connection area and above that two areas disposed side by side, being one used for the command terminal and another slightly more elevated, used for the auxiliary terminals, where this different elevation of areas are intended to distinguish the terminals.

Additionally, according to the description of the U.S. Pat. No. 8,159,321, the command terminals and auxiliary terminals are disposed uniformly spaced and distributed along the frame, to favor the assembly.

The U.S. Pat. No. 3,639,866, describes an electromagnetic relay and a relay-adder combination with a constant actuating force. This relay has a coil at its lower part; above the coil a region for the fixed contacts and above the fixed contacts there is a region for the coil terminals.

It is possible to see that since a long time there is a concern to distinguish connection terminals to prevent incorrect wiring.

SUMMARY OF INVENTION

The present invention comprises an electromagnetic switching device, with several distinct regions, where each region separates and places the terminals and the connection means in an improved form.

The objective of the proposed invention is to make easy the identification of the terminals for the user. When the contactor is fixed in the rail inside the panel, it is visible only from the top. In this manner, a level difference between the terminals cannot clearly identify the terminals; that is even worse with low illumination, commonly found in this field.

This invention presents a clear distinction between auxiliary terminals and command terminals of the coil given by the asymmetry created for this purpose, differently of the others from state of art that don't have this distinction.

The proposed architecture in this device creates four distinct regions, where the first region, have function of fixing the contactor on the panel and also houses the electromagnet, in a manner to make easy the coil interchange for maintenance.

The second region that extends from the first region, comprises the power terminals, which, when isolated in a distinct region, are easily connected to protection devices, such as motor circuit breaker or overload relay. This positioning also makes easy the use of connection busbars to make a reversion kit of an electric motor.

The third region that extends from the second region, houses the auxiliary and the command terminals, creating a region of control and monitoring of the device. Different from the other solutions, the terminals are disposed asymmetrically and uneven, in the same region. The asymmetry grants a clear visualization and distinction between auxiliary terminals and command terminals, by putting away the command coil terminals from the auxiliary terminals; that reduces the chances of incorrect wiring. The uneven disposition of the terminals makes easy the use of a connection busbar, for example, a parallel busbar that can be used to energize several subsequent contactors. Additionally, the uneven disposition of the terminals provides a better distinction between auxiliary and command terminals.

The fourth region that extends from the third region is used for the connection of front mounting accessories, such as auxiliary contact blocks, timer blocks, surge suppressor modules, and also an empty block for replacing this; includes also a groove especially designed for passing cables. This type of division proposes advantages for installation and maintenance of these additional components, once it is above all the other regions, being the first region accessed by the user.

It is visible, therefore, a combination of the proposed uneven disposition of the command and auxiliary terminals in the same region when viewed from the front, added with the asymmetry of the terminals when viewed from the top, which grants a doubled visual identification not characterized on the others from "state of art".

These functional arrangements and advantages will become clearer, with the support of the drawings that will be used to illustrate the constructive details.

BRIEF DESCRIPTION OF THE DRAWINGS

The FIG. 1 shows a perspective view, of the subdivision of the regions and defines the top view A, frontal view B, rear view D and side view C.

The FIG. 2 shows a frontal view of the contactor.

Figure 3:
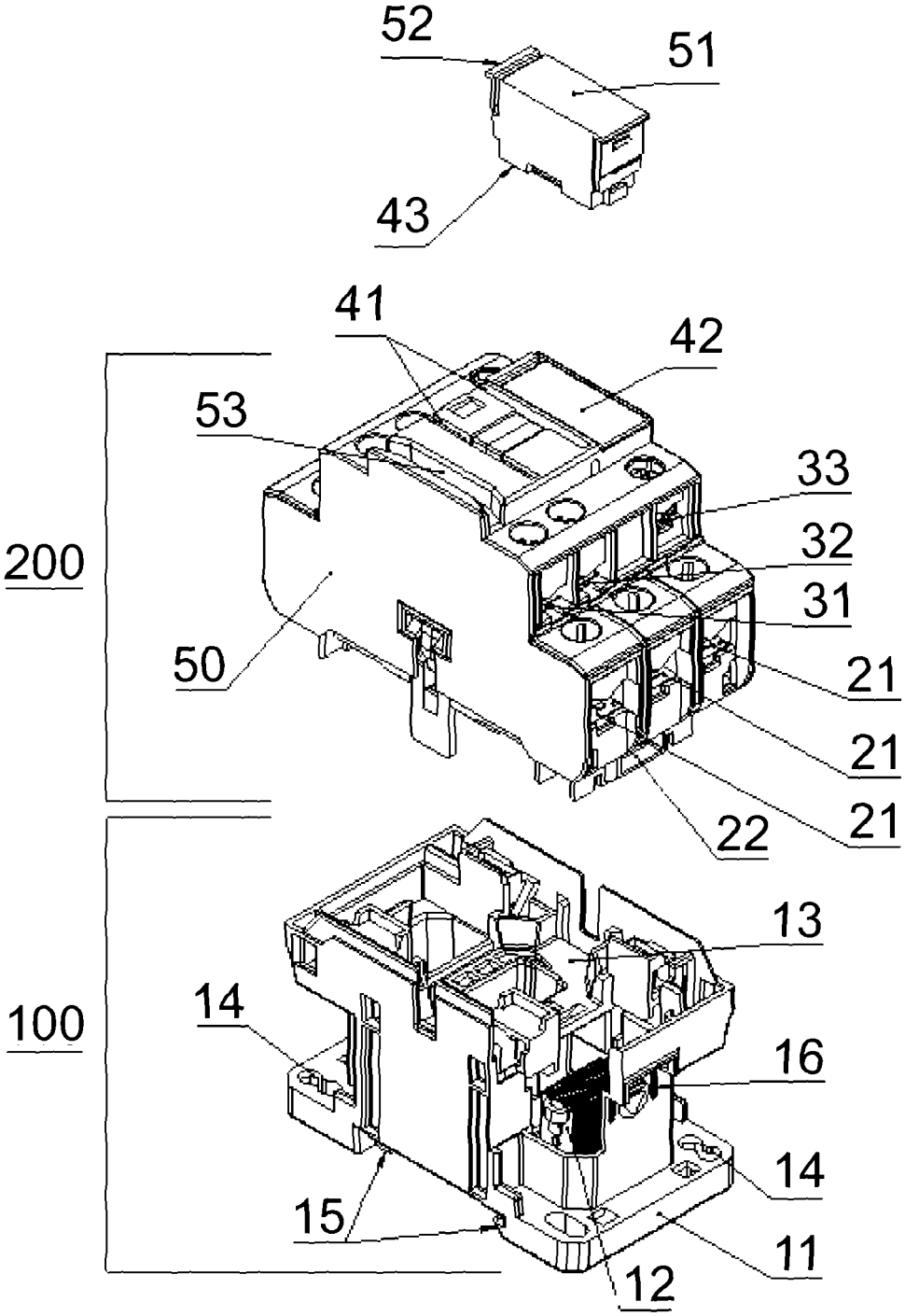

The FIG. 3 shows a perspective exploded view of the contactor.

Figure 4:
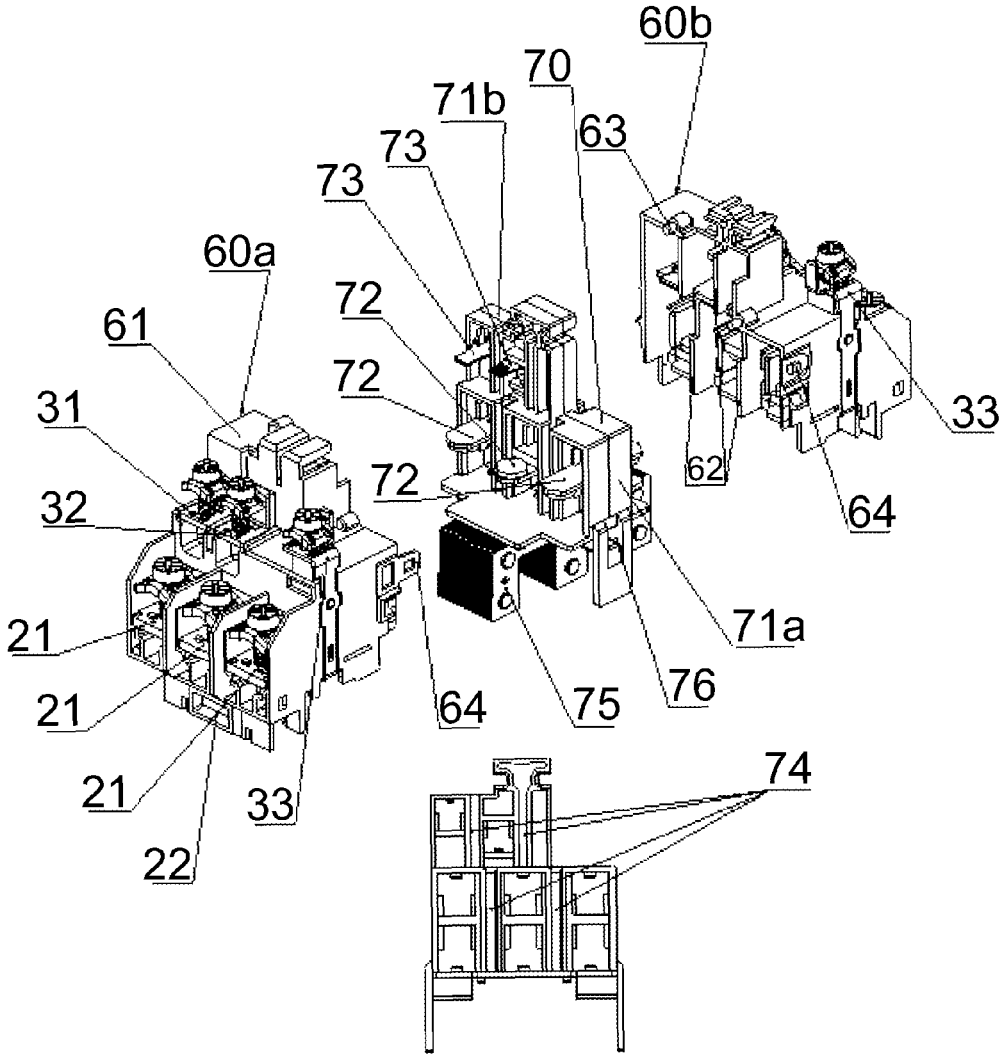

The FIG. 4 shows an internal exploded view of the upper part of the contactor.

Figure 5:
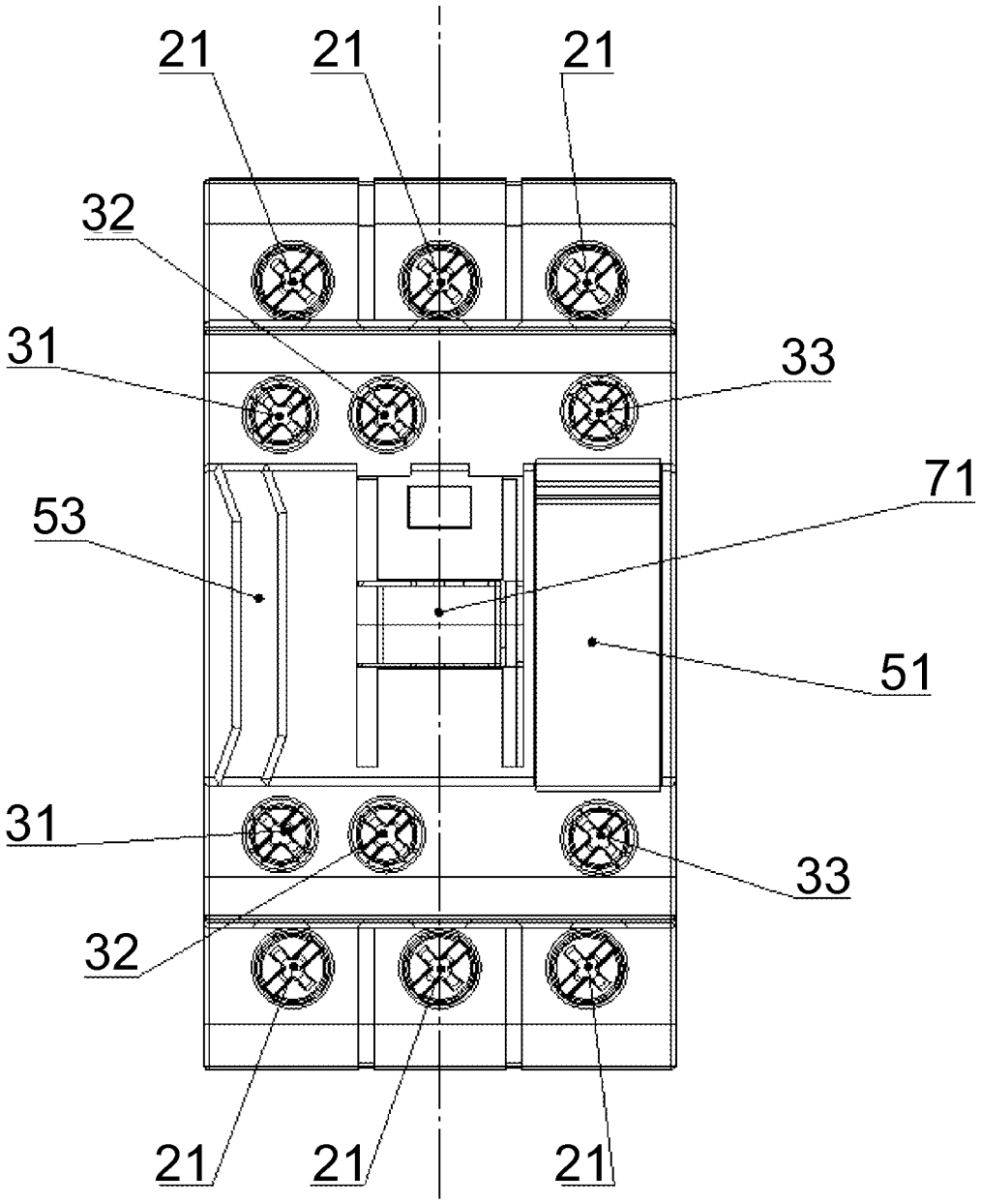

The FIG. 5 shows a top view of the contactor.

DETAILED DESCRIPTION OF THE PREFERRED EMBODIMENT

According to the FIGS. 1 to 5), in a preferred embodiment, the multipolar contactor (1) is divided in four distinct regions. The first region (10) is composed by a base (11) that houses a fixed armature (12) and a coil (13) from an electromagnet. The base also is responsible by the fixation of the product for use. This fixation can be done using screws (not illustrated), using the holes (14), or even by rails using their connection means (15).

The second region (20) is composed by the power terminals (21) that will receive the power conductors (not shown). The region (10) is connected with the region (20) by snap-fits (16) that belongs to the base (11) and are fitted in the holes (22), that belongs to the frames (60*a*) e (60*b*).

The third region (30) is composed by the auxiliary terminals (31, 32) that will receive the auxiliary conductors (not shown). The third region (30) also includes the command terminals of the coil (33), which will receive the command conductors (not shown).

The fourth region (40) is dedicated for the connection of accessories. The entries (41) are used for fitting front mounting auxiliary devices, for example, a front mounting auxiliary contact block, a timer block or even a communication module. This region also presents a cover as an empty block (42) that in its turn can be removed for an introduction of a surge suppressor block (43). This block, in its turn has the shape similar to the cover (42). The suppressor block is introduced in the cover (50) leaving its external face (51) exposed, completing the cover (50). The face (51) of the surge suppressor block (43) is exposed to make easy the visualization of the type of surge suppressor and posterior removal or exchange. The surge suppressor block (43) is fixed or removed by a snap-fit (52) that is manually actuated by the user.

The lower part (100) of the contactor is mainly composed by the base (11), a fixed armature (12), a coil (13), snap-fits (16), and also comprises the fixing regions (14) and (15) of the contactor.

The upper part (200) of the contactor is externally composed by the cover (50). Inside the cover, the contactor is divided in three distinct parts being these: two fixation frames (60*a*) and (60*b*) and a moveable contact carrier (70). The frames (60*a*) e (60*b*) has the function of housing the power terminals (21), the auxiliary terminals (31, 32) and the command terminals (33). These two frames have ribs (62) that provide electrical insulation between the various live parts of the contactor. The frames are connected to each other using the centralizer pins (63) and snap-fits (64). The moveable contact carrier (70) has as main part the carrier (71*a*) which slides axially inside both frames, the ribs (62) of the frames are fitted inside grooves (74) limiting the movement of the carrier only axially. The carrier support the moveable power contacts (72) and the moveable auxiliary contacts (73). Coupled in the lower part of the carrier (70) is the moveable armature (75). The carrier (70) also have an aperture (76), that can be additionally used to mechanically couple a side mounting accessory, for example, a side mounting auxiliary contacts block or a mechanical interlock device.

Figure 1:
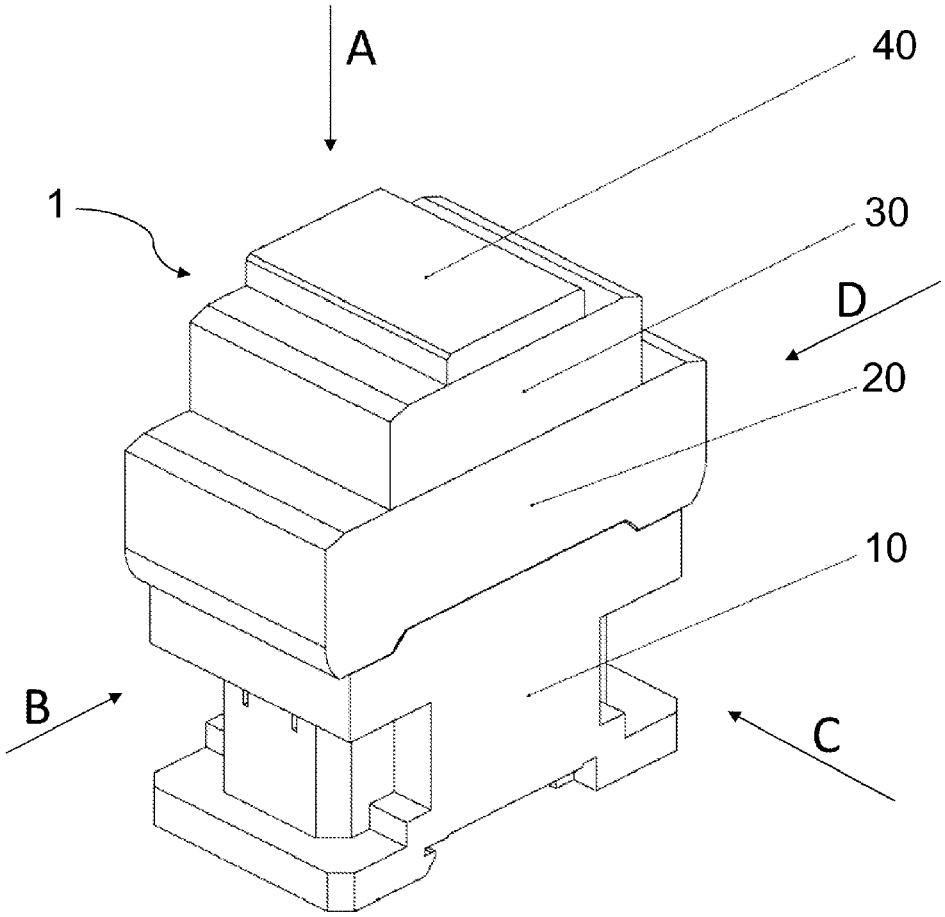
Figure 2:
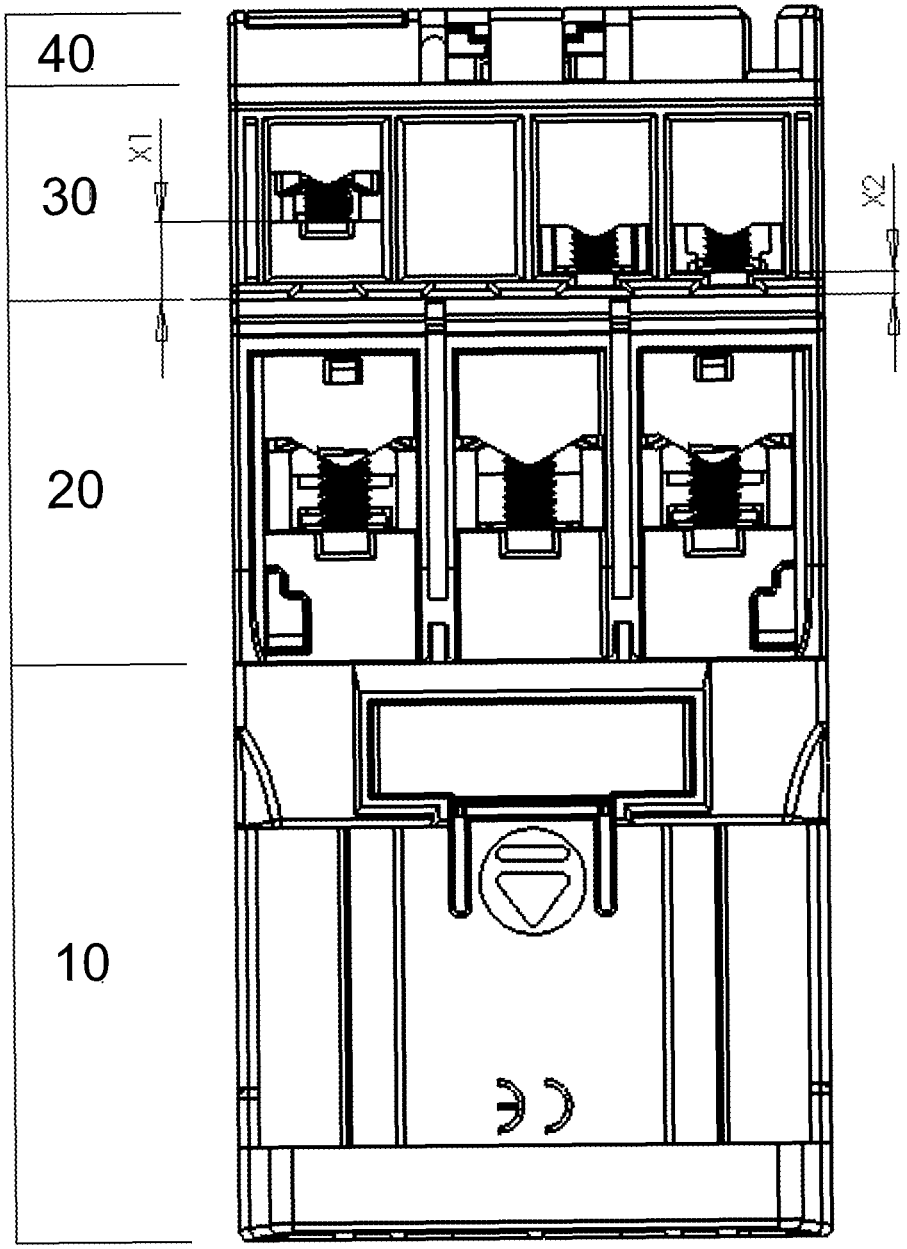

The FIG. 5 shows a top view of the contactor, where is possible to visualize that in one extremity of the frame the auxiliary contact terminals (31, 32) are arranged, and in the other extremity the command terminals (33) are arranged. The terminals are asymmetrically disposed to evidence the distinction between these terminals. In the FIG. 2 is possible to visualize that further the asymmetry of the disposal of the auxiliary and the command terminals, they are clearly uneven by heights X1 and X2. This difference amplifies the distinction between the terminals, reducing the possibility of incorrect wiring. This unevenness places the command terminal above the auxiliary terminals, becoming easy to mount a busbar between these terminals, to make for example, an electrical interlock between two contactors (not shown).

The invention claimed is:

1. An electromagnetic switching device with several regions of connection, particularly a contactor having a plurality of command terminals and one or more auxiliary terminals wherein the contactor provides a visual distinction between the command terminals and the auxiliary terminals, the device comprising:

a first region, wherein the first region includes a base that is adapted for fixing the contactor to a panel, and a housing that accessibly encloses an electromagnet, the electromagnet comprising a fixed armature and a coil;

a second region, wherein the second region occupies an area located substantially above the first region and is releasably attached to a top of the first region, the second region further comprising a plurality of power terminals, each power terminal adapted to receive a power conductor, and a plurality of moveable power contacts, each moveable power contact being associated with one of the power terminals and adapted to controllably close a circuit associated with the power terminal;

a third region, wherein the third region occupies an area located substantially above the second region and comprises the command terminals and the one or more auxiliary terminals, the command terminals being electrically connected to the coil and located at a first height above a bottom of the third region, and the one or more auxiliary terminals being located at a second height above the bottom of the third region, the first and second heights being different from each other, and wherein the command terminals and the auxiliary terminals are distributed across the third region in an asymmetrical manner that groups the auxiliary terminals together and leaves the command terminals standing apart from the auxiliary terminals so that the command terminals are visually distinguishable from the auxiliary terminals when viewed from a top of the third region, and wherein the command terminals and the auxiliary terminals are integrated into the construction of the third region; and a fourth region, wherein the fourth region occupies an area located substantially above the third region, the fourth region being adapted for connection of accessories.

2. An electromagnetic switching device with several regions of connection according to claim 1, wherein the first height is greater than the second height so that the command terminals are located above the auxiliary terminals and a visual distinction is provided between the command terminals and the one or more auxiliary terminals.

3. An electromagnetic switching device with several regions of connection according to claim 1, wherein the second height is greater than the first height so that the auxiliary terminals are located above the command terminals and a visual distinction is provided between the one or more auxiliary terminals and the command terminals.

4. An electromagnetic switching device with several regions of connection according to claim 1, wherein the third region of the said device further comprises moveable auxiliary contacts, each moveable auxiliary contact being associated with one of the auxiliary terminals and adapted to controllably close a circuit associated with the auxiliary terminal.

5. An electromagnetic switching device with several regions of connection according to claim 2, wherein each command terminal in the third region is adapted for connection to a command terminal of a second electromagnetic switching device via a busbar.

6. An electromagnetic switching device with several regions of connection according to claim 1, wherein the second region is connected to the first region by snap-fits that belong to the base and are fitted in the holes, that release-ably connect to the housing of the first region, and wherein the housing of the first region provides access to the electromagnet so that the coil can be replaced for maintenance.

7. An electromagnetic switching device with several regions of connection according to claim 1, wherein the third region comprises a plurality of command terminals, each command terminal adapted to receive a command conductor.

8. An electromagnetic switching device with several regions of connection according to claim 1, wherein the second region further comprises a moveable carrier support that houses and limits the movement of the moveable power contacts.

9. An electromagnetic switching device with several regions of connection according to claim 1, wherein the third region further comprises a second carrier support that houses and limits the movement of the moveable auxiliary contacts.

10. An electromagnetic switching device with several regions of connection according to claim 1, wherein the fourth region presents a cover as an empty block that can be removed for an introduction of a surge suppressor block.

11. An electromagnetic switching device with several regions of connection according to claim 1, wherein the fourth region is configured to receive a front mounting auxiliary contact block, a timer or a communication module.

12. A method for use in an electromagnetic switching device with several regions of connection, particularly including an electromagnetic contactor having a plurality of command terminals and one or more auxiliary terminals, wherein the contactor provides a visual distinction between the command terminals and the auxiliary terminals, the method comprising:

providing a first region on the contactor, wherein the first region includes a base that is adapted for fixing the contactor to a panel, and a housing that accessibly encloses an electromagnet, the electromagnet comprising a fixed armature and a coil;

providing a second region on the contactor, wherein the second region occupies an area located substantially above the first region and is release-ably attached to a top of the first region, the second region further comprising a plurality of power terminals, each power terminal adapted to receive a power conductor, and a plurality of moveable power contacts, each moveable power contact being associated with one of the power terminals and adapted to controllably close a circuit associated with the associated power terminal;

providing a third region on the contactor, wherein the third region occupies an area located substantially above the second region and comprises the command terminals and the one or more auxiliary terminals, the command terminals being electrically connected to the coil and located at a first height above a bottom of the third region, and the one or more auxiliary terminals being located at a second height above the bottom of the third region, the first and second heights being different from each other, and wherein the command terminals and the auxiliary terminals are distributed across the third region in an asymmetrical manner that groups the auxiliary terminals together and leaves the command terminals standing alone so that the command terminals are visually distinguishable from the auxiliary terminals when viewed from a top of the third region, and wherein the command terminals and the auxiliary terminals are integrated into the construction of the third region; and providing a fourth region on the contactor, wherein the fourth region occupies an area located substantially above the third region, the fourth region being adapted for connection of accessories.

13. A method for use in an electromagnetic switching device with several regions of connection according to claim 12, wherein the first height is greater than the second height so that the command terminals are located above the auxiliary terminals and a visual distinction is provided between the command terminals and the one or more auxiliary terminals.

14. A method for use in an electromagnetic switching device with several regions of connection according to claim 12, wherein the second height is greater than the first height so that the auxiliary terminals are located above the command terminals and a visual distinction is provided between the one or more auxiliary terminals and the command terminals.

15. A method for use in an electromagnetic switching device with several regions of connection according to claim 12, wherein the third region further comprises moveable auxiliary contacts, each moveable auxiliary contact being associated with one of the auxiliary terminals and adapted to controllably close a circuit associated with the associated auxiliary terminals.

16. A method for use in an electromagnetic switching device with several regions of connection according to claim 12, wherein the base of the first region includes a connection means adapted for fixing the contactor to a rail of the panel, or a plurality of holes, each hole being adapted for passage there-through of a screw that can be used to fix the contactor to the panel.

17. A method for use in an electromagnetic switching device with several regions of connection according to claim 13, wherein each command terminal in the third region is adapted for connection to a command terminal of a second electromagnetic contactor via a busbar.

18. A method for use in an electromagnetic switching device with several regions of connection according to claim 12, wherein the second region is connected to the first region by snap-fits which belong to the base and are fitted in the holes, that release-ably connect to the housing of the first region, and wherein the housing of the first region provides access to the electromagnet so that the coil can be replaced for maintenance.

19. A method for use in an electromagnetic switching device with several regions of connection according to claim 12, wherein the third region further comprises a plurality of command terminals, each command terminal adapted to receive a command conductor.

20. A method for use in an electromagnetic switching device with several regions of connection according to claim 12, wherein the second region further comprises a carrier support that houses and limits the movement of the moveable power contacts.

21. A method for use in an electromagnetic switching device with several regions of connection according to claim 12, wherein the third region further comprises a second carrier support that houses and limits the movement of the moveable auxiliary contacts.

22. A method for use in an electromagnetic switching device with several regions of connection according to claim 12, wherein the fourth region includes a surge suppressor block located at the top of the contactor so that the surge suppressor block can be inspected for type and exchange when necessary.

23. A method for use in an electromagnetic switching device with several regions of connection according to claim 12, wherein the fourth region includes a front mounting auxiliary contact block, a timer or a communication module.

* * * * *